US009272409B2

(12) United States Patent
Suhami

(10) Patent No.: US 9,272,409 B2
(45) Date of Patent: Mar. 1, 2016

(54) COMBINATORIAL OBJECTS FORMED BY PARTS FOLDING INTO POCKET-KNIFE LIKE ENCLOSURES

(71) Applicant: David Suhami, Tel-Aviv (IL)

(72) Inventor: David Suhami, Tel-Aviv (IL)

( * ) Notice: Subject to any disclaimer, the term of this patent is extended or adjusted under 35 U.S.C. 154(b) by 279 days.

(21) Appl. No.: 13/870,998

(22) Filed: Apr. 26, 2013

(65) Prior Publication Data

US 2013/0283539 A1 Oct. 31, 2013

Related U.S. Application Data

(60) Provisional application No. 61/640,065, filed on Apr. 30, 2012.

(51) Int. Cl.
*B25F 1/04* (2006.01)
*B26B 11/00* (2006.01)

(52) U.S. Cl.
CPC ..... *B25F 1/04* (2013.01); *B26B 11/001* (2013.01)

(58) Field of Classification Search
CPC ..... B25F 1/00; B25F 1/04; B26B 11/00; B26B 11/001
USPC ..... 81/118, 151, 155, 156, 158, 165; D8/38, 105; 7/118, 151, 155, 156, 158, 7/165
See application file for complete search history.

(56) References Cited

U.S. PATENT DOCUMENTS

| | | | | | |
|---|---|---|---|---|---|
| 152,250 | A * | 6/1874 | Powers | 446/310 |
| 769,650 | A * | 9/1904 | Harrison | 7/118 |
| D117,768 | S * | 11/1939 | Casebeer | D8/38 |
| D141,968 | S * | 8/1945 | Ranseen | D8/38 |
| D476,545 | S * | 7/2003 | Gamble | D8/100 |
| 2006/0266161 | A1* | 11/2006 | Mulcaire | 81/3.45 |
| 2008/0236210 | A1* | 10/2008 | Frazer | 7/128 |

* cited by examiner

*Primary Examiner* — Hadi Shakeri

(57) ABSTRACT

The invention describes objects that may be formed by unfolding and combining in space several parts, initially folded into a pocket-knife-like enclosure.

1 Claim, 5 Drawing Sheets

COMBINATORIAL OBJECTS FORMED BY PARTS FOLDING INTO POCKET-KNIFE LIKE ENCLOSURES

This utility application claims benefit of provisional application No. 61,640,065 titled "Combinatorial objects formed by parts folding into pocket-knife like enclosures" filed on Apr. 30, 2012.

FIELD OF THE INVENTION

This invention relates to the field of Toys

SUMMARY OF THE INVENTION

The invention is an assortment of parts folded in a common pocket-knife like enclosure, that when unfolded in different combinations, form different objects.

For example, when the parts folded into the common enclosure, are animal body parts, the user may unfold out of the common longitudinal enclosure, an animal head, a tail and two legs. They are all attached at one of their ends to said common enclosure that serves as the animal body, and thus form an animal figurine that may resemble a real animal or an imaginery one. Another example is an enclosure holding an assortment of airplane parts; the user may unfold two long and two short wings out of the lateral openings of the longitudinal enclosure that serves as the airplane body, and form a figurine that resembles an airplane.

The article may be used in its various combinations, as a combinatorial ornamental object while one or more of its retrievable parts may also serve as an utensil.

For example a suitable shaped part of the enclosure may also serve as a nail file, a letter opener, a wine or beer bottle opener or as a screw-driver.

DETAILED DESCRIPTION OF THE PREFERRED EMBODIMENTS

Figure 1:
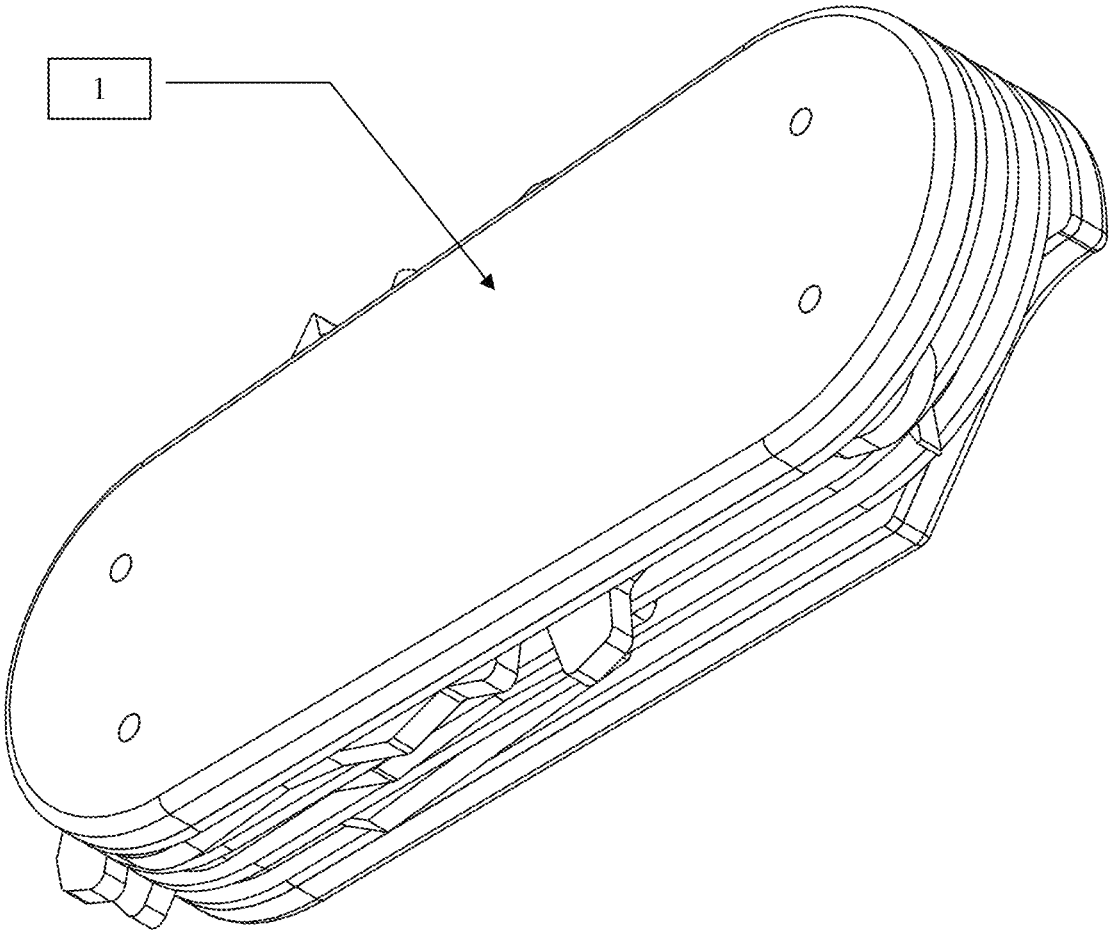
FIG. 1 illustrates an Animal "Pocket Knife" like enclosure where the retrievable parts are folded into the enclosure.

FIG. 1 shows the view of the enclosure 1 wherein the retrivable parts are folded into it. The illustrated enclosure has 12 retrievable parts out of which 3 animals may be built, using the enclosure as the body of the animal and 4 of the retrievable parts as its head, tail and limbs. In addition several useful utensils may be incorporated into the enclosure.

Figure 2:
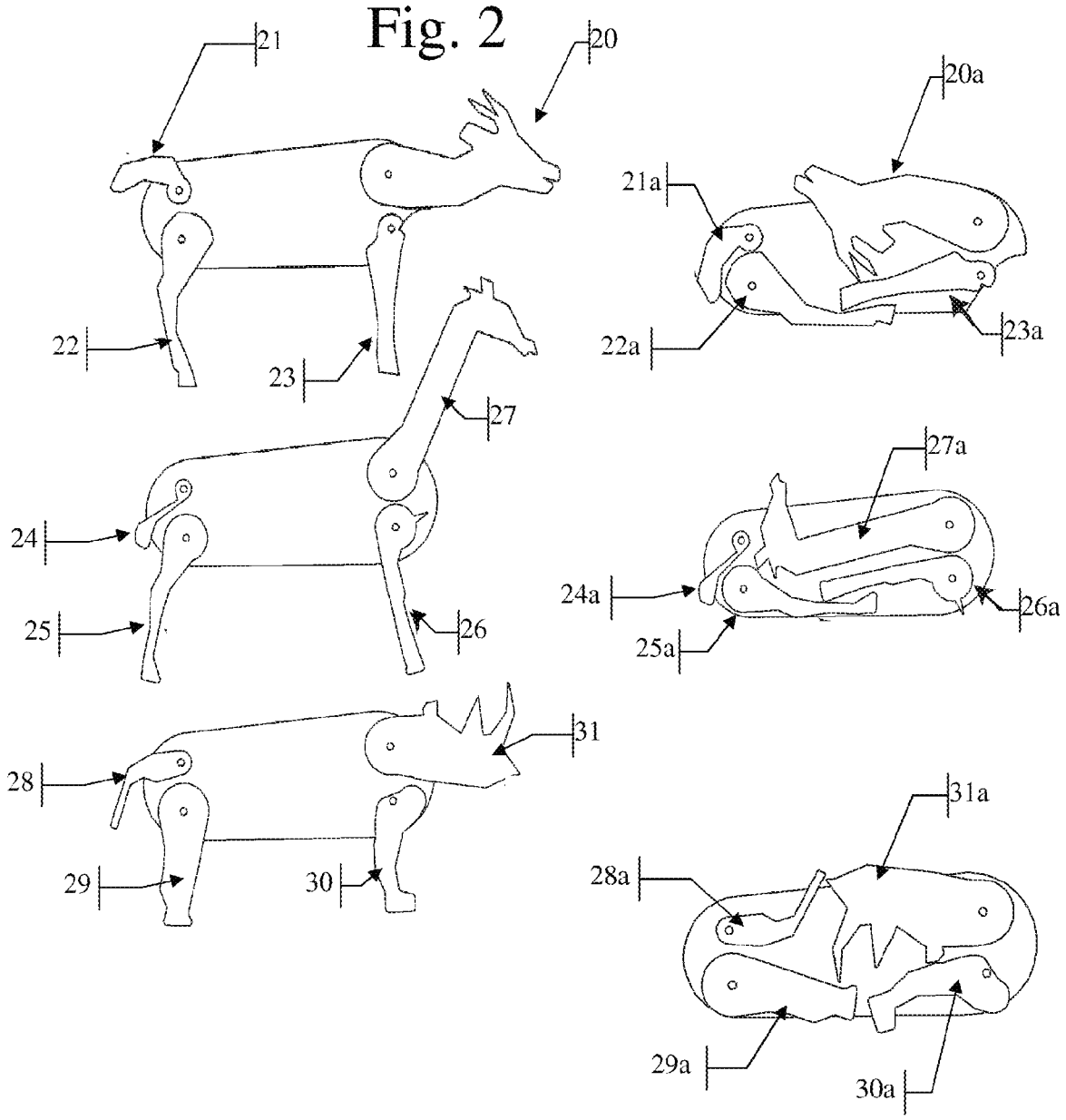
FIG. 2 illustrates the various combinations of animal figurine silhouettes that can be formed with the unfolded retrievable parts stemming out of the enclosure.

FIG. 2 illustrates 3 combinations of animal figurines that may be built out of the 12 retrievable parts and the enclosure.

An "antelope" may be built around the enclosure 1 that serves as the body, and unfolding the parts that serve as the head 20*a*, the tail 21*a*, the hind leg 22*a* and the fore leg 23*a*. The parts 20, 21, 22, and 23 properly positioned around the body of the knife form an "antelope" figurine.

In a similar way a "giraffe" may be built around the enclosure by unfolding the head 27*a*, the tail 24*a*, a hind leg 25*a* and fore leg 26*a*. The parts 24, 25, 26, and 27 properly positioned around the enclosure form a silhouette of the "giraffe".

A "Rhinoceros" may be built around the enclosure serving as the body of the animal by unfolding the head 31*a*, the tail 28*a*, the hind leg 29*a* and the fore leg 30*a*. The parts 28, 29, 30, and 31 properly positioned around the enclosure serving as the body form the silhouette of a rhino.

In principle there is no constraint to use different "Legs" for the different animals, other than "esthetics". Using the same legs for the 3 animals saves 4 retrievable parts. These savings may be used to insert more heads, that characterize other animals and thus "build" more animal figurines; or make the enclosure thinner.

Figure 3:
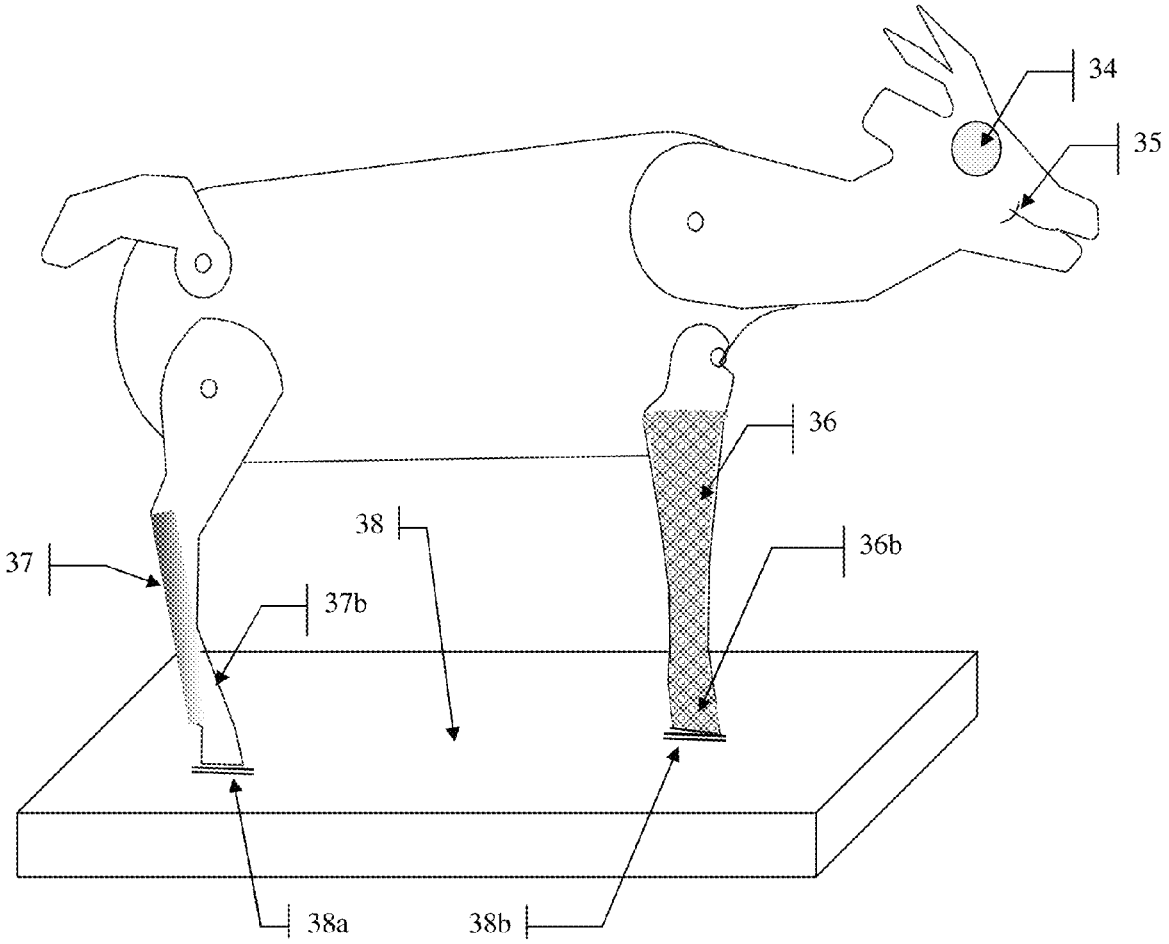
FIG. 3 illustrates the dual use of the retrievable parts that can also be used as a lens, a knife and a file.

FIG. 3 illustrates a flat, preferably wooden base 38, on top of which the animal silhouettes may stand by inserting the hind and fore legs into slits 38*a*, 38*b* carved into the base.

FIG. 3 also illustrates the incorporation into the animal figurines, of some components that may serve as practical utensils. Such dual-use parts may include a Magnifying Lens 34 also used to represent the "eye"of the animal; one of the legs of the animal, if properly machined may also serve as a "nail file" 36 or as a screwdriver 36*b*, another leg if properly sharpened along its length may serve as a "knife" 37 or a "letter opener" 37*b*.

Figure 4:
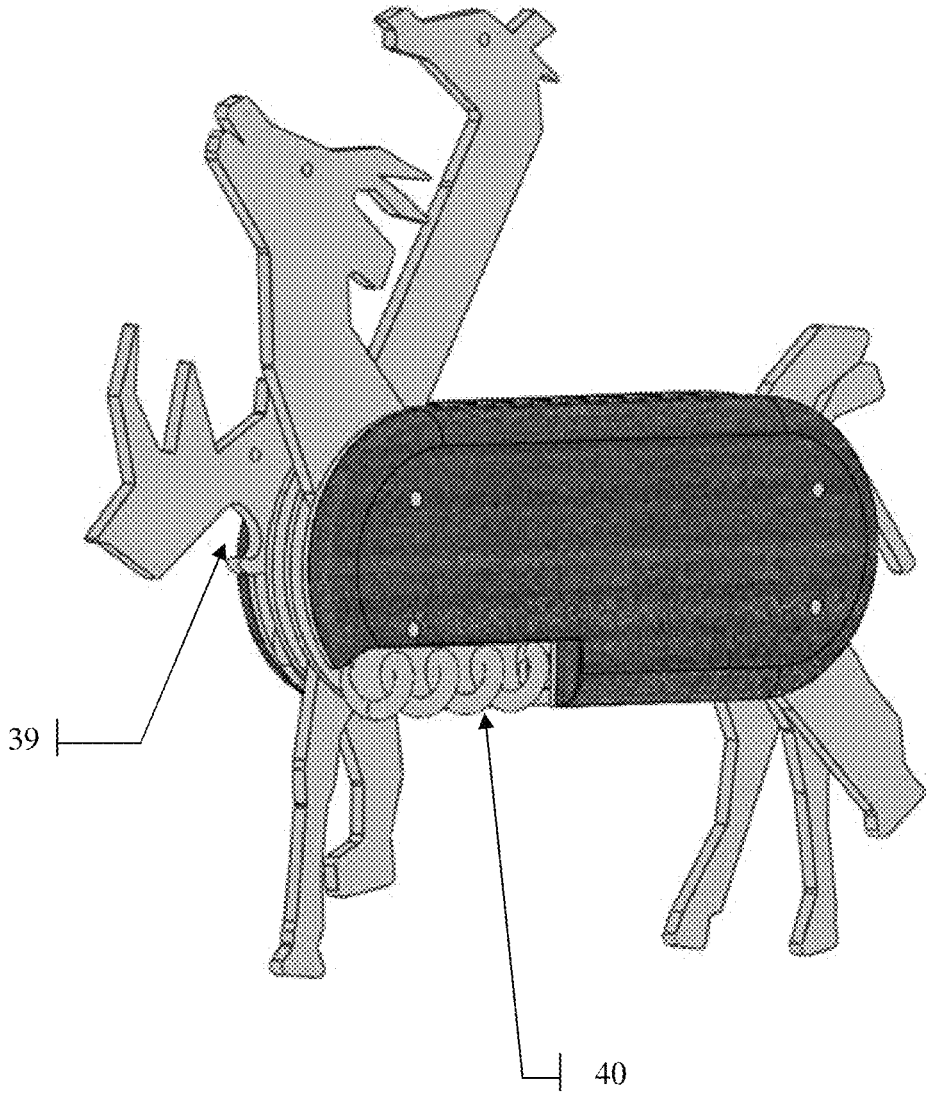
FIG. 4 illustrates additional retrievable parts in the form of a screw like wine bottle opener and a beer bottle opener.

FIG. 4 illustrates an animal pocket knife incorporating a screw-like wine bottle opener 40 and one of the retrievable parts of the animal figurine that is shaped like a beer-bottle opener 39.

Figure 5:
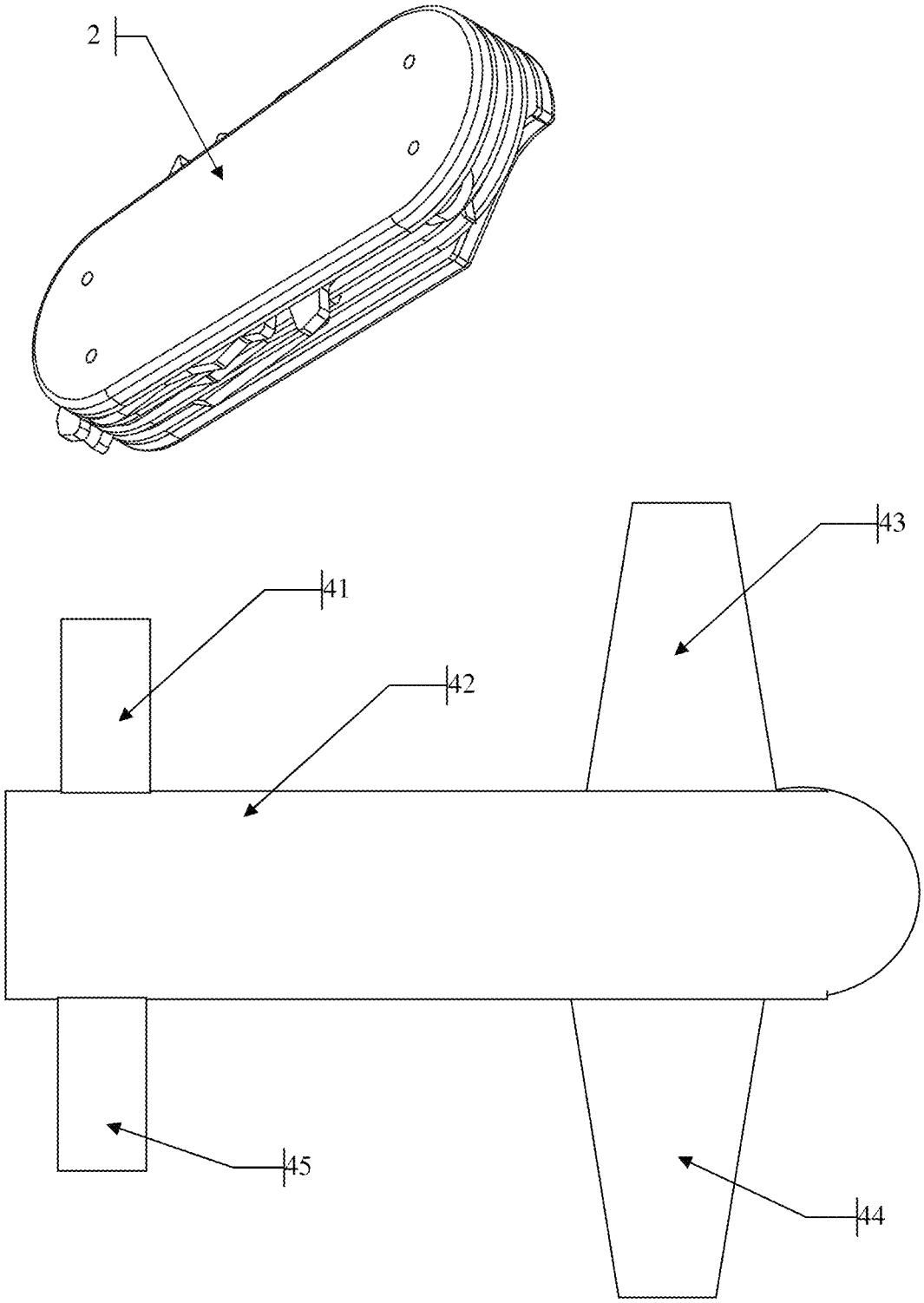
FIG. 5 illustrates a plane that can be "constructed" out of retrievable parts folded into the enclosure.

FIG. 5 illustrates an enclosure 2 incorporating 4 parts of an airplane figurine, 41, 42, 43, 44 and 45 that together with the "enclosure", form the silhouette of an airplane Small retrievable protruding parts on the flat part of the enclosure may also simulate the cockpit and the tail of the airplane. If, for example, the "pocket knife" contains 12 retrievable parts, the user can use a large number of plane combinations to build a Plane figurine.

There are multiple ways to realize the invention explained above, combine the differentiating features illustrated in the accompanying figures, and devise new embodiments of the method described, without departing from the scope and spirit of the present invention. Those skilled in the art will recognize that other embodiments and modifications are possible. While the invention has been described with respect to the preferred embodiments thereof, it will be understood by those skilled in the art that changes may be made in the above constructions and in the foregoing sequences of operation without departing substantially from the scope and spirit of the invention. All such changes, combinations, modifications and variations are intended to be included herein within the scope of the present invention, as defined by the claims. It is accordingly intended that all matter contained in the above description or shown in the accompanying figures be interpreted as illustrative rather than in a limiting sense.

I claim:

1. A multi-functional folding tool comprising:

an enclosure;

a plurality of retrievable parts each pivotally attached at one end to said enclosure, wherein some of said retrievable parts when unfolded to extend to outside said enclosure, form together with the attached enclosure, various combinatorial objects;

wherein at least some of the retrievable parts are shaped so as to also serve as useful utensils, each of said useful utensils defining a tool from a list comprising a knife, a letter opener, a nail file, a screwdriver, a wine bottle opener, a beer bottle opener, and a magnifying glass;

wherein said retrievable parts resemble animal limbs, heads and tails such that, combinatorial objects resembling animal figurines are formed out of said unfolded parts; and wherein same retrievable parts serve as limbs of different animal figurines.

* * * * *